US005468599A

United States Patent [19]

Biavasco et al.

[11] Patent Number: 5,468,599

[45] Date of Patent: Nov. 21, 1995

[54] SILVER HALIDE PHOTOGRAPHIC MATERIAL WITH REDUCED FOG AND IMPROVED RESIDUAL STAIN

[75] Inventors: Raffaella Biavasco, Savona, Italy; Mark Kirk, Bishop's Stortford, United Kingdom; Giovanni Giribone, Carcare, Italy

[73] Assignee: Minnesota Mining and Manufacturing Company, St. Paul, Minn.

[21] Appl. No.: 329,529

[22] Filed: Oct. 26, 1994

[30] Foreign Application Priority Data

Nov. 27, 1993 [EP] European Pat. Off. ..... 93119176

[51] Int. Cl.[6] ..... G03C 1/06; G03C 1/825

[52] U.S. Cl. ..... 430/512; 430/517; 430/567; 430/966

[58] Field of Search ..... 430/517, 512, 430/966, 567

[56] References Cited

U.S. PATENT DOCUMENTS

| | | | |
|---|---|---|---|
| 3,178,285 | 4/1965 | Anderau et al. | 430/512 |
| 4,347,301 | 8/1982 | Kliem | 430/217 |
| 4,387,155 | 6/1983 | Hill et al. | 430/588 |
| 4,504,570 | 3/1985 | Evans et al. | 430/567 |
| 4,732,845 | 3/1988 | Keiji et al. | 430/551 |
| 4,818,675 | 4/1989 | Miyasaka et al. | 430/567 |
| 5,158,892 | 10/1992 | Sasaki et al. | 430/603 |
| 5,213,951 | 5/1993 | Delfino | 430/504 |

FOREIGN PATENT DOCUMENTS

| | | |
|---|---|---|
| 1558999 | 1/1969 | France . |
| 2044971 | 2/1971 | France . |
| 1917589 | 4/1970 | Germany . |
| 1265842 | 3/1972 | United Kingdom . |

*Primary Examiner*—Janet C. Baxter
*Attorney, Agent, or Firm*—Gary L. Griswold; Walter N. Kirn; Mark A. Litman

[57] ABSTRACT

A silver halide photographic material having at least one silver halide light-sensitive emulsion layer on at least one side of a support, wherein said silver halide emulsion layer comprises tabular silver halide grains having a grain thickness of 0.3 μm or less and accounting for at least 50% of the total projected area, and a phthalocyanine blue pigment having a maximum absorption wave length of from 640 to 700 nm is present in said silver halide emulsion layer and/or in another hydrophilic layer of the photographic material.

15 Claims, No Drawings

SILVER HALIDE PHOTOGRAPHIC MATERIAL WITH REDUCED FOG AND IMPROVED RESIDUAL STAIN

FIELD OF THE INVENTION

The present invention relates to a light sensitive silver halide photographic material, having reduced fog and improved residual stain of the image and, in particular, to a light sensitive silver halide photographic material comprising tabular silver halide grains.

BACKGROUND OF THE INVENTION

The covering power of a silver halide emulsion is a matter of a great concern for emulsion makers, because the amount of silver required to maintain a given optical density can be decreased by using an emulsion having a high covering power. It is disclosed in U.S. Pat. Nos. 4,411,986, 4,434,226, 4,413,053, 4,414,304, 4,414,306, 4,435,501 that the covering power of developed silver can be greatly increased by using tabular grain emulsions having a high aspect ratio (i.e., diameter to thickness ratio) and a small grain thickness.

It is known that the use of tabular grains of a highly sensitive emulsion having a small average grain thickness provides high covering power for silver, as compared with the covering power of emulsions which have a large average grain size and a large average grain thickness.

Moreover, the use of intermediate (from 5:1 to 8:1) and high (more than 8:1) aspect ratio tabular grain emulsions can produce increased image sharpness, and improved speed-granularity relationships. In radiographic elements with emulsion coatings on each of the two opposite faces of the support, marked reductions in crossover have been observed using intermediate and high aspect ratio tabular grain emulsions.

A disadvantage that has been discovered with the use of spectrally sensitized tabular grain silver halide emulsions is related to a bad color tone of developed silver of emulsion grains. The color tone of developed silver of emulsion grains depends upon the grain size and grain thickness. The tone of tabular grains is yellowish, and gives an unfavorable impression to the observer of the resulting picture image. This yellowishness is caused by the strong yellowish light produced by the increase in scattering of blue light due to decrease in size and thickness of the grains. In order to solve such a problem, a tone regulating agent is generally used. For example, a certain kind of mercapto compound may be used for this purpose. However, application of such a conventionally known tone regulating agent to an emulsion having tabular grains causes extreme desensitization, and thus, such an emulsion cannot be put into practice.

Japanese Laid Open Patent No. 158,436/1985 discloses a technique for improving the color tone of a silver image by including a fluorescent brightener in a sensitive material comprising an emulsion of tabular silver halide grains having a grain size of 5 times or more the grain thickness.

U.S. Pat. No. 4,818,675 discloses a technique for improving blackness of a silver image by including a dye having a maximum absorption wavelength of from 520 to 580 nm in a sensitive material comprising an emulsion of tabular silver halide grains having a thickness of 0.4 μm or less.

Another disadvantage relates to the formation of dye stain caused by the residual spectral sensitizing dye which remains in the photographic element at the end of the processing. Dye stain can be undesirable in altering image tone. Variations in image tone are particularly undesirable in radiography, since this can complicate proper interpretation of X-ray images. Furthermore, residual dye stain is highly objectionable in that it does not affect all wavelengths equally.

U.S. Pat. No. 4,520,098 discloses a technique for improving dye stain of a silver image by including, in proximity to the spectrally sensitized tabular grains, relatively fine high iodide silver halide grains capable of being dissolved during fixing.

U.S. Pat. No. 5,213,951 discloses a silver halide emulsion material comprising tabular silver halide grains and a blue pigment having a maximum absorption wavelength of from 570 to 630 nm to improve residual dye stain. The blue pigment is represented by a phthalocyanine dye having insolubilizing groups as substituents.

U.S. Pat. No. 3,996,050 discloses a color transfer photographic material in which phthalocyanine compounds may be used as optical whitener agents being capable of absorbing light within a wavelength range complementary to that absorbed by the stains.

U.S. Pat. No. 3,178,285 discloses a color photographic material for silver dyestuff bleaching process comprising a silver halide layer sensitized to red comprising a phthalocyanine dye. The dye is used in order to obtain a colored image from a positive black-and-white silver halide photographic material by the bleaching process.

U.S. Pat. No. 3,705,807 discloses a radiographic material which can be handled under safety lights of high intensity without risks of undue exposure by means of a blue filter dye. Nothing in this patent discloses the specific problem of residual dye stain in radiographic materials containing tabular silver halide grains as well as the use of such a blue pigment to solve this problem.

It could be desirable to have a silver halide photographic material that solves the problem of the residual stain, presents a reduced fog, and still substantially maintaining the same speed.

SUMMARY OF THE INVENTION

The present invention relates to a silver halide photographic material having at least one silver halide light-sensitive emulsion layer on at least one side of a support, wherein said silver halide emulsion layer comprises tabular silver halide grains having a grain thickness of 0.3 μm or less and accounting for at least 50% of the total projected area, wherein a phthalocyanine blue pigment having a maximum absorption wavelength of from 640 to 700 nm is present in said silver halide emulsion layer and/or in another hydrophilic layer of said material.

It has been found that the introduction of said pigment in said silver halide emulsion layer and/or in another hydrophilic layer reduces dye stain in the photographic material containing silver halide tabular grains and reduces the fog value, while still substantially maintaining the same high speed.

DETAILED DESCRIPTION OF THE INVENTION

Accordingly, the present invention relates to a silver halide photographic material having at least one silver halide light-sensitive emulsion layer on at least one side of a support, wherein said silver halide emulsion layer comprises tabular silver halide grains having a grain thickness of 0.3

μm or less and accounting for at least 50% of the total projected area, and a phthalocyanine blue pigment having a maximum absorption wavelength of from 640 to 700 nm is present in said silver halide emulsion layer and/or in another hydrophilic layer of said material.

In a particular embodiment of the present invention, said phthalocyanine blue pigment has a maximum absorption wavelength of from 650 to 690 nm, more preferably of from 660 to 680 nm.

The phthalocyanine blue pigments for use in the present invention are insoluble compounds. Theoretically, the term "insoluble" is referred to any solvent. Practically, "insoluble" is at least referred to water and to the solvent in which the pigments are to be used. They are incorporated into the photographic materials by means of a dispersion. As they are required to be insoluble in water, they must have a high molecular weight and lack solubilizing groups. Solubilizing groups are groups such as carboxylic group, sulfonic group, salt groups, hydroxylic group, and the like. More detailed characteristics of pigments are described, for example, in "The Chemistry of Synthetic Dyes", K. Venkateraman, Volume V, Chapter VI. Other references can be found in "Color Index", The Society of Dyers and Colorists, Volume 2, Pigments. In a preferred embodiment of the present invention, such pigments may be selected from the group of phthalocyanine pigments of the following formula:

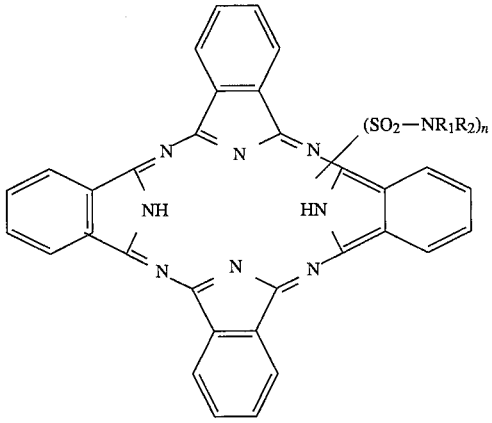

wherein $R_1$ and $R_2$, being the same or different, each represents H or an alkyl group having 1 to 4 carbon atoms (such as methyl, ethyl, propyl, and the like) and n is an integer of 1 to 4.

In a more preferred embodiment such pigments may be selected from metal phthalocyanine pigments of the following formula:

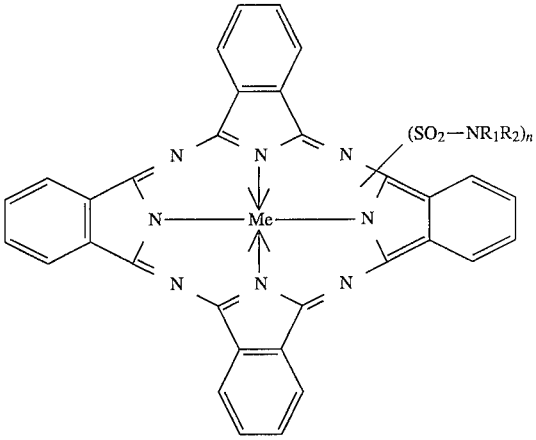

wherein $R_1$, $R_2$ and n are the same as defined above and Me is a divalent metallic atom. Examples of divalent metallic atoms are Cu, Co, Mn, Sn, Pb, Ni, Zn, Fe, Mg and the like.

When the term "group" is used in this invention to describe a chemical compound or substituent, the described chemical material includes the basic group and that group with conventional substitution. When the term "moiety" is used to describe a chemical compound or substituent, only an unsubstituted chemical material is intended to be included. For example, "alkyl group" includes not only such alkyl moieties as methyl, ethyl, octyl, stearyl, etc., but also such moieties bearing substituent groups such as halogen, cyano, hydroxyl, nitro, amine, carboxylate, etc. On the other hand, "alkyl moiety" includes only methyl, ethyl, stearyl, cyclohexyl, etc.

Specific pigments to be used in the present invention are shown below. However, the present invention is not limited to these pigments.

(I)

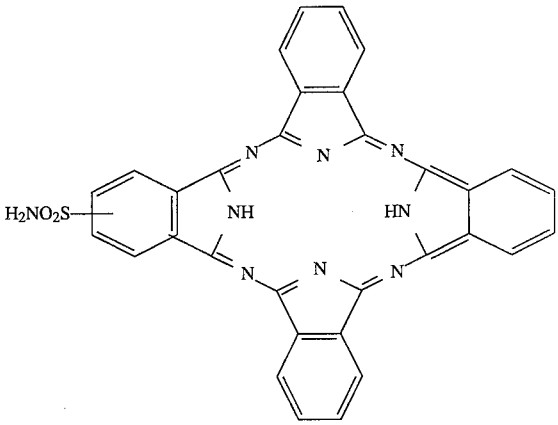

-continued (II)

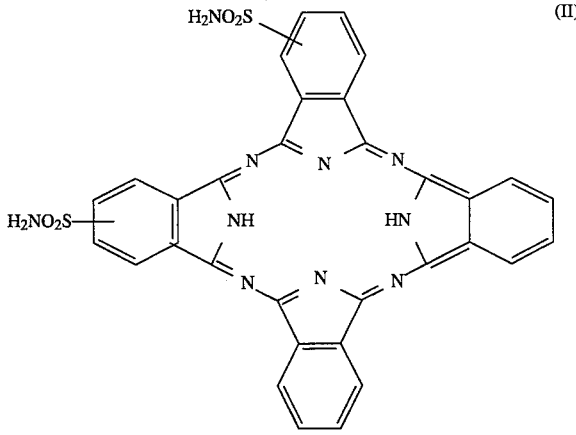

(III)

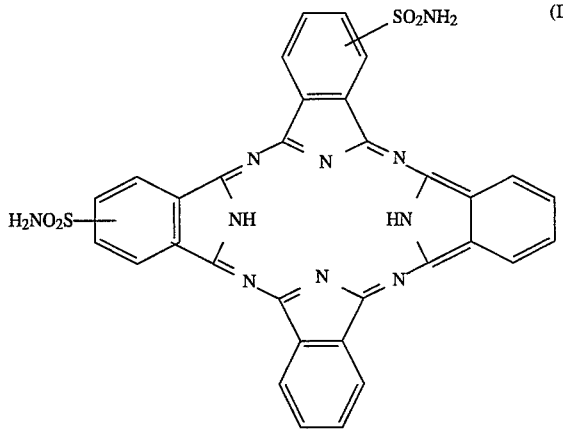

(IV)

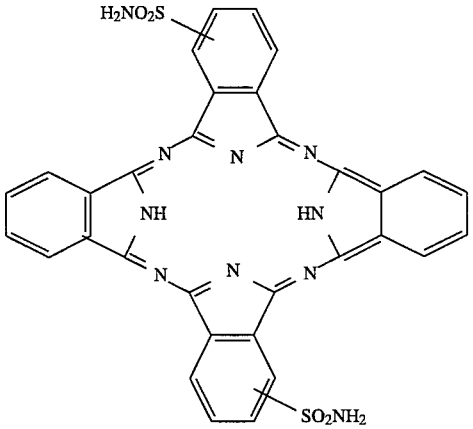

-continued (V)

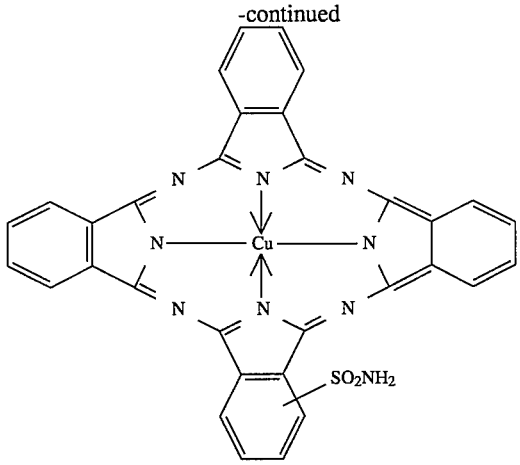

The pigment to be used in the present invention can be dispersed in a silver halide emulsion layer and/or other hydrophilic layers (e.g. an intermediate layer, a protective layer, an anti-halo layer, a filter layer and the like) by means of (1) directly dispersing the fine divided pigment in the silver halide emulsion layer or other hydrophilic colloid layers, or (2) dispersing the pigment in water or in an organic solvent and then introducing the dispersion into the emulsion layer or the hydrophilic layer. The second method is preferred. In particular, it is preferred to use pigment dispersions or pastes manufactured and sold under brand names by various manufacturers, e.g., Orasol Blue sold by Ciba-Geigy A. G.

The pigment to be used in the present invention can be dispersed in a silver halide emulsion layer or other hydrophilic layers (e.g. an intermediate layer, a protective layer, an anti-halo layer, a filter layer and the like). Preferably, it can be dispersed in the silver halide emulsion layer or in the protective layer to obtain better speed.

The amount of the pigment to be added is of from 0.001 to 0.5 g/m$^2$, preferably of from 0.005 to 0.1 g/m$^2$, more preferably of from 0.005 to 0.05 g/m$^2$ although the amount depends on the kind of pigment and its absorbance. However, the amount of the blue pigment used in the present invention is such that the optical density, measured at 670 nm, of the layer containing said pigment is in the range of from 0.01 to 0.1, preferably of from 0.02 to 0.05 after the developing treatment.

The light-sensitive silver halide photographic material of this invention may be a black-and-white photographic material such as X-ray light-sensitive material, black-and-white photographic printing paper, black-and-white negative film, etc.

In a particular embodiment the photographic material of the present invention may be an X-ray photographic material which comprises a polymeric base of the type commonly used in radiography, for instance a polyester base, in particular a polyethylene terephthalate base.

On at least one surface, preferably on both surfaces of the base there is coated a silver halide emulsion layer in a hydrophilic colloid. The emulsions coated on the two surfaces may also be different and comprise emulsions commonly used in photographic elements, such as silver chloride, silver iodide, silver chloro-bromide, silver chloro-bromo-iodide, silver bromide and silver bromo-iodide emulsions, the silver bromo-iodide emulsions being particularly useful for the X-ray elements. The silver halide crystals may have different shapes, for instance cubic, octahedral, spherical, tabular shapes, and may have epitaxial growth. In the practice of the present invention the photographic material contains at least one silver halide light-sensitive emulsion layer which comprises tabular silver halide grains having a thickness of 0.3 μm or less and accounting for at least 50% of the total projected area of the silver halide grains present in the emulsion.

The emulsions are coated on the base at a total silver coverage comprised in the range from about 2 to 6 $g/m^2$, preferably 3 to 5 $g/m^2$. The silver halide binding material used is a water-permeable hydrophilic colloid, which is preferably gelatin, but other hydrophilic colloids, such as gelatin derivatives, albumin, polyvinyl alcohol, alginates, cellulose hydrolized esters, hydrophilic polyvinyl polymers, dextrans, polyacrylamides, alkylacrylates and acrylamide hydrophilic copolymers can also be used, alone or in combination with gelatin.

Silver halide emulsions containing tabular silver halide grains can be prepared with various processes known in the conventional technology for the preparation of photographic materials. Silver halide emulsions can be prepared by the acid process, neutral process or ammonia process. In the stage for the preparation, a soluble silver salt and a halogen salt can be reacted in accordance with the single jet process, double jet process, reverse mixing process or a combination process by adjusting the conditions in the grain formation, such as pH, pAg, temperature, form and scale of the reaction vessel and the reaction method. A silver halide solvent, such as ammonia, thioethers, thioureas, etc., may be used, if desired, for controlling grain size, form of the grains, particle size distribution of the grains, and the grain-growth rate.

Preparation of silver halide emulsions containing tabular silver halide grains is described, for example, in de Cugnac and Chateau, "Evolution of the Morphology of Silver Bromide Crystals During Physical Ripening", Science and Industries Photographiques, Vol. 33, No.2 (1962), pp.121–125, in Gutoff, "Nucleation and Growth Rates During the Precipitation of Silver Halide Photographic Emulsions", Photographic Science and Engineering, Vol. 14, No. 4 (1970), pp. 248–257,in Berry et al., "Effects of Environment on the Growth of Silver Bromide Microcrystals", Vol.5, No.6 (1961), pp. 332–336, in U.S. Pat. Nos. 4,063,951, 4,067,739, 4,184,878, 4,434,226, 4,414,310, 4,386,156, 4,414,306, in EP Pat. Appln. No. 263,508 and in Research Disclosure, Item 22534, January 1983.

In preparing the silver halide emulsions containing tabular silver halide grains, a wide variety of hydrophilic dispersing agents for the silver halides can be employed. Gelatin is preferred, although other colloidal materials such as gelatin derivatives, colloidal albumin, cellulose derivatives or synthetic hydrophilic polymers can be used as described above.

The silver halide emulsions containing tabular silver halide grains used in the present invention can be chemically and optically sensitized with methods well known in the art. The silver halide emulsion layer containing the tabular silver halide grains of this invention can contain other constituents generally used in such products, such as binders, hardeners, surfactants, speed-increasing agents, plasticizers, optical sensitizers, dyes, ultraviolet absorbers, etc., and reference can be made to, for example, Research Disclosure, Vol. 176 (December 1978), pp. 22–28. Ordinary silver halide grains may be incorporated in the emulsion layer containing the tabular silver halide grains as well as in other silver halide emulsion layers of the light-sensitive silver halide photographic material of this invention. Such grains can be prepared by processes well known in the photographic art.

Tabular silver halide grains are defined as those having two substantially parallel major crystal faces. The term tabular grain emulsion is defined as requiring that the tabular silver halide grains having a thickness of 0.3 μm or less account for at least 50% of the total projected area of the silver halide grains present in the emulsion.

Preferred tabular grain emulsions are intermediate and high aspect ratio tabular grain emulsions. As applied to tabular grain emulsions, the term "high aspect ratio" is defined as requiring that the silver halide grains having a thickness of 0.3 μm or less and a diameter of at least 0.6 μm have an average aspect ratio of at least 8:1 and account for at least 50% of the total projected area of the silver halide grains present in the emulsion. The term is thus defined in conformity with the term used in the patents relating to tabular grain emulsions cited above.

The term "intermediate aspect ratio" as applied to tabular grain emulsions is defined as requiring that the tabular silver halide grains having a thickness of 0.3 μm or less and a diameter of at least 0.6 μm have an average aspect ratio in the range of from 5:1 to 8:1 and account for at least 50% of the total projected area of the silver halide grains present in the emulsion. The term "thin intermediate aspect ratio" is similarly defined, except that the reference thickness of 0.3 μm is replaced by a reference thickness of 0.2 μm.

The grain characteristics described above of the tabular silver halide grains can be readily ascertained by procedures well known to those skilled in the art. The term "diameter" is defined as the diameter of a circle having an area equal to the projected area of the grain. The term "thickness" means the distance between the two substantially parallel main planes constituting the tabular silver halide grains. From the measure of diameter and thickness of each grain the diameter:thickness of each grain can be calculated, and the diameter:thickness ratios of all tabular grains can be averaged to obtain their average diameter:thickness ratio. By this definition the average diameter:thickness ratio is the average of individual tabular grain diameter:thickness ratios. In practice it is simpler to obtain an average diameter and an average thickness of the tabular grains and to calculate the average diameter:thickness ratio as the ratio of these two averages. Whatever the used method may be, the average diameter:thickness ratios obtained do not significantly differ.

According the present invention in the silver halide emulsion layer containing tabular silver halide grains, at least 50% of the silver halide grains are tabular grains having a thickness of 0.3 μm or less and an average diameter:thickness ratio of at least 5:1. More preferably, at least 70% of the silver halide grains are tabular grains having a thickness of 0.3 μm or less and an average diameter:thickness ratio of not less than 5:1. Each of the above proportions, "50%" and "70%" means the proportion of the total projected area of the tabular grains having a diameter:thickness ratio of at least 5:1 to the projected area of all of the silver halide grains in the layer. Other conventional silver halide grain structures such as cubic, orthorhombic, tetrahedral, etc. may make up the remainder of the grains.

The preferred spectral sensitizing dyes for radiographic elements are chosen to exhibit an absorption peak shift in their absorbed state, normally in the J-band, to a region of the spectrum corresponding to the wavelength of electromagnetic radiation to which the element is intended to be image-wise exposed. The electromagnetic radiation producing image-wise exposure is typically emitted from phosphors of intensifying screens. A separate intensifying screen exposes each of the two imaging units located on opposite sides of the support. The intensifying screen can emit light in the ultraviolet, blue, green or red portions of the spectrum, depending upon the specific phosphors chosen for incorporation therein. In a specifically preferred form phosphors emitting in the green portion of the spectrum are chosen.

It is known in the art of radiographic photographic material that the intensity of the sharp absorption band (J-band) shown by the spectral sensitizing dye absorbed on the surface of the light-sensitive silver halide grains will vary with the quantity of the specific dye chosen as well as the size and chemical composition of the grains. The maximum intensity of J-band has been obtained with silver halide grains having the above described sizes and the chemical compositions absorbed with J-band spectral sensitizing dyes in a concentration of from 25 to 100 percent or more of monolayer coverage of the total available surface area of said silver halide grains. Optimum dye concentration levels can be chosen in the range of 0.5 to 20 millimoles per mole of silver halide, preferably in the range of 2 to 10 millimoles.

The J-band spectral sensitizing dyes are preferably added to the silver halide emulsions in the presence of a water soluble iodide or bromide salt. The J-band exhibited by said dyes absorbed on said grains is increased by the presence of said salts, increasing the strong coloration of the element before processing and consequently reducing the cross-over of exposing radiations by adding a smaller amount of dye. Said salts are more advantageously added to the silver halide emulsion before dye digestion, that is the pause following dye addition; said pause is preferably made at a temperature of 40° to 60° C. for a time of about 50 to 150 minutes.

Typical water soluble salts include alkali metal, alkali earth metal and ammonium iodide and bromide such as ammonium, potassium, lithium, sodium, cadmium and strontium iodides and bromides. The amount of said water soluble iodide and bromide salts is advantageously in a range of from 50 to 5,000 mg per mole of silver, and preferably from 100 to 1,000 mg per mole of silver. We have surprisingly found that the use of the blue pigment of the present invention reduces the quantity needed of said salts to obtain the same effect shown by a radiographic element without said blue pigment.

Spectral sensitizing dyes producing J aggregates are well known in the art, as illustrated by F. M. Hamer, *Cyanine Dyes and Related Compounds,* John Wiley and Sons, 1964, Chapter XVII and by T. H. James, *The Theory of the Photographic Process,* 4th edition, Macmillan, 1977, Chapter 8.

In a preferred form, J-band exhibiting dyes are cyanine dyes. Such dyes comprise two basic heterocyclic nuclei joined by a linkage of methine groups. The heterocyclic nuclei preferably include fused benzene rings to enhance J aggregation. The heterocyclic nuclei are preferably quinolinium, benzoxazolium, benzothiazolium, benzoselenazolium, benzimidazolium, naphthoxazolium, naphthothiazolium and naphthoselenazolium quaternary salts.

It is known in the photographic art that photographic speed obtainable from the silver halide grains increases with the increasing concentration of the sensitizing dye until maximum speed is obtained with an optimum dye concentration, after that, further increases in dye concentration cause a decrease in the obtainable speed. The optimum amount of sensitizing dye employed can vary depending upon the specific sensitizing dye, as well as upon the size and aspect of the grains.

In addition to the features specifically described above, the photographic elements of this invention, in the light-sensitive silver halide emulsion layers or in other layers, can include additional addenda of conventional nature, such as stabilizers, antifoggants, brighteners, absorbing materials, hardeners, coating aids, plasticizers, lubricants, matting agents, antikinking agents, antistatic agents, and the like, as described in Research Disclosure, Item 17643, December 1978 and in Research Disclosure, Item 18431, August 1979. Research Disclosure is published by Kennet Mason Publication, Ltd., The Old Harbourmaster's, 8 North Street, Emsworth, Hampshire, England.

Preferred radiographic elements are of the type described in BE Patent 757,815, in U.S. Pat. Nos. 3,705,858, 4,425, 425, 4,425,426 and 4.413,053, i.e. elements wherein at least one light-sensitive silver halide emulsion layer is coated on both surfaces of a transparent support, the total silver coverage per surface unit for both layers being lower than about 6 g/m$^2$, preferably than 5 g/m$^2$. Such supports are preferably polyester film supports, such as polyethylene terephthalate films. Generally said supports for use in medical radiography are blue tinted. Preferred dyes are anthraquinone dyes, such as those described in U.S. Pat. Nos. 3,488,195; 3,849,139; 3,918,976; 3,933,502; 3,948,664 and in UK Patents 1,250,983 and 1,372,668.

The exposed radiographic elements can be processed by any of the conventional processing techniques. Such processing techniques are illustrated for example in Research Disclosure, Item 17643, cited above. Roller transport processing is particularly preferred, as illustrated in U.S. Pat. Nos. 3,025,779; 3,515,556; 3,545,971 and 3,647,459 and in UK Patent 1,269,268. Hardening development can be undertaken, as illustrated in U.S. Pat. No. 3,232,761.

As regards the processes for the silver halide emulsion preparation and the use of particular ingredients in the emulsion and in the light-sensitive element, reference is made to Research Disclosure, Item 18,431, August 1979, wherein the following chapters are dealt with in deeper details:

IA. Preparation, purification and concentration methods for silver halide emulsions.
Ib. Emulsion types.
IC. Crystal chemical sensitization and doping.
II. Stabilizers, antifogging and antifolding agents.
IIA. Stabilizers and/or antifoggants.
IIB. Stabilization or emulsions chemically sensitized with gold compounds.
IIC. Stabilization of emulsions containing polyalkylene oxides or plasticizers.
IID. Fog caused by metal contaminants.
IIE. Stabilization of materials comprising agents to increase the covering power.
IIF. Antifoggants for dichroic fog.
IIG. Antifoggants for hardeners and developers comprising hardeners.
IIH. Additions to minimize desensitization due to folding.
III. Antifoggants for emulsions coated on polyester bases.
IIJ. Methods to stabilize emulsions at safety lights.

IIK. Methods to stabilize x-ray materials used for high temperature. Rapid Access, roller processor transport processing.
IIL. Compounds and antistatic layers.
IV. Protective layers.
V. Direct positive materials.
VI. Materials for processing at room light.
VII. X-ray color materials.
VIII. Phosphors and intensifying screens.
IX. Spectral sensitization.
X. UV-sensitive materials
XII. Bases and to Research Disclosure, Item 308119, December 1989, wherein the following chapters are dealt with in deeper details:
I. Emulsion preparation and types
II. Emulsion washing
III. Chemical sensitization
IV. Spectral sensitization and desensitization
V. Brighteners
VI. Antifoggant and stabilizer
VIII. Absorbing and scattering material
IX. Vehicle and vehicle extenders
X. Hardeners
XI. Coating aids
XII. Plasticizers and lubricants
XIII. Antistatic layers
XIV. Methods of addition
XV. Coating and drying procedure
XVI. Matting agents
XVII. Supports
XIX. Processing The present invention is now illustrated by reference to the following examples.

EXAMPLE 1

Emulsion Preparation

A tabular grain silver bromide emulsion (having an average diameter to thickness ratio of about 8:1) chemically sensitized with gold and sulfur, spectrally sensitized with anhydro-5,5'-dichloro-9-ethyl-3,3'-di-(3-sulfopropyl)-oxacarbocyanine hydroxide and stabilized with 5-methyl-7-hydroxy-1,3,4-triazaindolizine was prepared and then added with a gelatin hardener.

Sample 1

A Colanyl Blue AR™ dye, manufactured by Hoechst Chemical Co., was added to water and rapidly stirred to produce a dispersion having a dye content of 1.65% of Compound A. The dye had maximum absorption wavelength of 600 nm. Then, the dye dispersion was added to the emulsion described hereinabove. The resulting emulsion was then coated on both sides of a subbed polyethylene terephthalate support base blue tinted with an anthraquinone dye (having a maximum absorption wavelength at 580 nm), at a total silver coverage of 4 g/m$^2$, dye coverage of 0.027 g/m$^2$ and gelatin coverage of 5.2 g/m$^2$.

A protective layer of gelatin at a coverage of 1 g/m$^2$ for side was coated over each emulsion layer.

Sample 2

Sample 2 was prepared as Sample 1, but the dye dispersion was prepared by dissolving 1.5 g of Orasol Blue 2GLN™ dye, a copper-phthalo-cyanine-sulfonamide dye manufactured by Ciba Geigy Ag. having a maximum absorption wavelength at 670 nm in ethyl acetate (3.38 g) and butyl acetanilide (5.93 g) and treated, while being agitated by a Silverston stirrer, with a solution of gelatin (10% 24.50 g), Hostapur SAS 93™ manufactured by Hoechst Chemical Co. (3.79 g) and water (60.90 g).

Sample 3

Sample 3 was prepared as Sample 2, but the Orasol Blue 2GLN™ dye was replaced by Orasol Blue GN™ dye, a copper-phthalocyanine-sulfonamide dye manufactured by Ciba Geigy Ag. having a maximum absorption wavelength at 666 nm.

Sample 4

Sample 4 was prepared as Sample 2, but the Orasol Blue 2GLN™ dye was replaced by Savinyl Blue GLS™ dye, a phthalocyanine dye having a maximum absorption wavelength at 669 nm manufactured by Sandox Chemical Co.

Sample 5

Sample 5 was prepared as Sample 2, but the Orasol Blue 2GLN™ dye was replaced by Compound B, a pigment having a maximum absorption wavelength at 676 nm.

Sample 6

Sample 6 was prepared as Sample 2, but the Orasol Blue 2GLN™ dye was replaced by Compound C, a pigment having a maximum absorption wavelength at 677 nm.

Sample 7

Sample 7 was prepared as Sample 2, but the Orasol Blue 2GLN™ dye was replaced by dye Compound D, a pigment having a maximum absorption wavelength at 634 nm.

Each sample was maintained for 15 h at 50° C., then exposed to a 75 KV X-ray source with 3M TRIMAX™ T8 intensifying screens, and processed in a 3M TRIMATIC™ XP515 automatic processor using a 3M XAD/3 Developer and a 3M XAF/3 Fixer. In table 1 are shown the sensitometric results.

TABLE 1

| Samples | Dmin | Speed | Shoulder Contrast | Residual Stain |
|---|---|---|---|---|
| 1 (reference) | 0.23 | 2.13 | 3.28 | blue/grey |
| 2 (invention) | 0.21 | 2.12 | 3.39 | blue |
| 3 (invention) | 0.21 | 2.10 | 3.35 | blue |
| 4 (invention) | 0.21 | 2.11 | 3.34 | blue |
| 5 (comparison) | 0.25 | 2.07 | 3.96 | blue |
| 6 (comparison) | 0.20 | 2.09 | 3.00 | red/grey |
| 7 (comparison) | 0.22 | 2.02 | 3.28 | blue |

Speed is expressed in log E (where E represents exposure in meter-candle-seconds) measured at a density of 1.0 above Dmin.

Table 1 shows that samples 2–4 of the present invention present better results in terms of Dmin and residual stain, still maintaining the same good results in terms of speed, compared to reference sample 1. Even if a reduction in the Dmin value of 0.02 seems to be not a significant result, in medical radiography it is to be considered a relevant result, because it produces better images that allow the final user to better evaluate patient's X-ray analysis. Comparison sample 5 has Dmin too high, comparison sample 6 has bad residual stain and comparison sample 7 has low speed.

This shows that the composition of the pigment is important in the performance of the invention. Even selecting other classes of pigments with absorption maxima in the same region does not produce as good an effect as compared to the phthalocyanines of the present invention.

The residual dye stain was measured with a DIANO spectrophotometer, manufactured by DIANO Co. which gives the C.I.E. (1976) L, a*, b*, coordinates. The main characteristics of this spectrophotometer are illumination D65, two observatory degrees and exclusion of specular component. In the following table 2, L means luminosity, a* means green tone and b* means blue tone. L has an inverse relationship to Dmin such that lower Dmin values correposnd to higher L values. It is preferred that L is higher than 80.50. The better results in residual dye stain are obtained when a* and b* values are, respectively, in the range from −5.50 to −6.50 and from −10.00 and −11.00. Table 2 shows that samples 2–4 of the present invention present better results in the column of the b* values compared with reference sample 1.

TABLE 2

| Samples | L | a* | b* |
|---|---|---|---|
| 1 | 80.80 | −5.96 | −11.30 |
| 2 | 82.03 | −6.29 | −10.51 |
| 3 | 82.09 | −5.88 | −10.25 |
| 4 | 81.74 | −6.46 | −10.66 |

Compound A

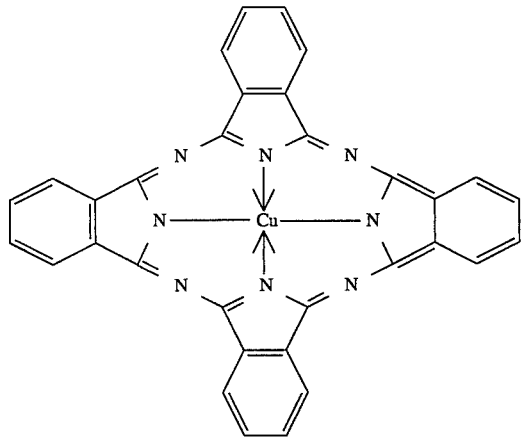

Compound B

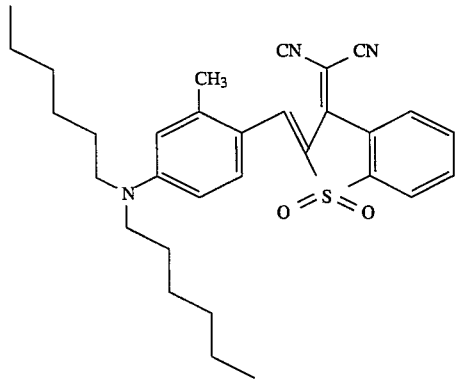

Compound C

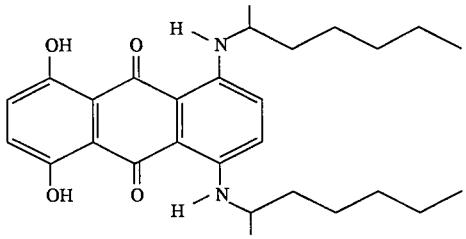

TABLE 2-continued

Compound D

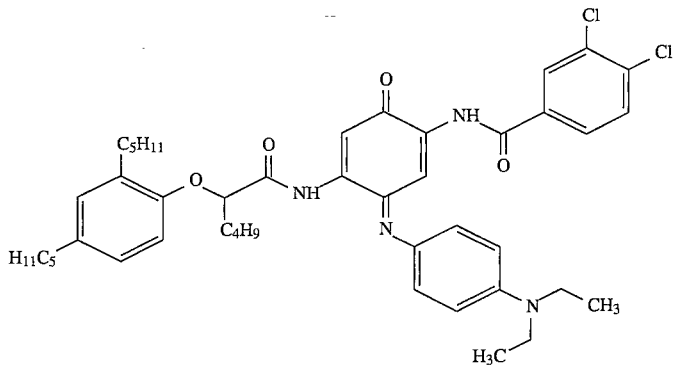

EXAMPLE 2

Sample 8

The dye of Sample 2 was included in the protective layer coated over the tabular grain emulsion layer rather than in the emulsion layer.

Sample 9

The dye of Sample 3 was included in the protective layer coated over the tabular grain emulsion layer rather than in the emulsion layer.

Sample 10

The dye of Sample 4 was included in the protective layer coated over the tabular grain emulsion layer rather than in the emulsion layer.

Samples 8, 9 and 10, together with Samples 2, 3 and 4 of Example 1, were maintained for 3 days at 38° C., then exposed as in Example 1. Table 2 shows the sensitometric results.

TABLE 3

| Samples | Location | Dmin | Speed | Residual Stain |
|---|---|---|---|---|
| 2 (invention) | emulsion | 0.20 | 2.04 | blue |
| 8 (invention) | protective | 0.21 | 2.07 | blue |
| 3 (invention) | emulsion | 0.21 | 2.06 | blue |
| 9 (invention) | protective | 0.22 | 2.08 | blue |
| 4 (invention) | emulsion | 0.19 | 2.04 | blue |
| 10 (invention) | protective | 0.20 | 2.08 | blue |

Table 2 shows that samples of the present invention present better results in terms of speed when the dyes are coated in the protective layer rather then in the emulsion layer, still maintaining the same good results in terms of residual stain.

We claim:

1. A black-and-white silver halide photographic material having at least one silver halide light-sensitive emulsion layer on at least one side of a support, wherein said silver halide emulsion layer comprises tabular silver halide grains having a grain thickness of 0.3 micrometers or less and accounting for at least 50% of the total projected area, characterized in that a phthalocyanine blue pigment having a maximum absorption wavelength of from 640 to 700 nm is present in at least one hydrophilic colloid layer of said photographic material.

2. A silver halide photographic material according to claim 1, characterized in that said phthalocyanine blue pigment has a maximum absorption wave length of from 650 to 690 nm.

3. A silver halide photographic material according to claim 1, characterized in that said phthalocyanine blue pigment has a maximum absorption wave length of from 660 to 680 nm.

4. A silver halide photographic material according to claim 1, wherein said phthalocyanine blue pigment has the following formula:

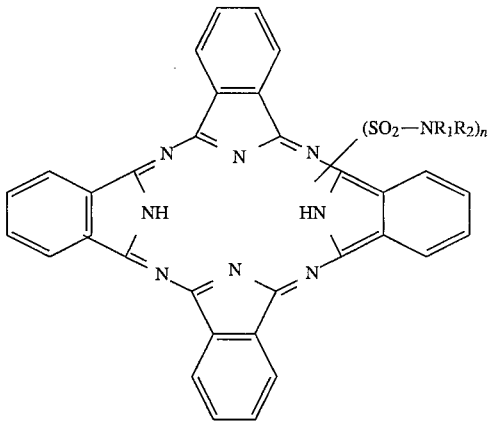

wherein $R_1$ and $R_2$, being the same or different, each represents H or an alkyl group and n is an integer of from 1 to 4.

5. A silver halide photographic material according to claim 1, characterized in that said phthalocyanine blue pigment is selected from the group of metal phthalocyanine pigments.

6. A silver halide photographic material according to claim 5, wherein said metal phthalocyanine blue pigment has the following formula:

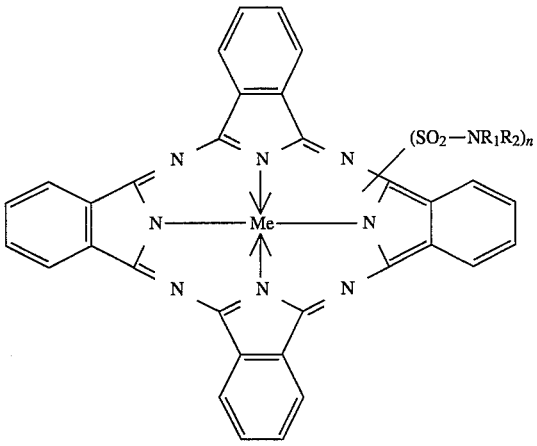

wherein $R_1$ and $R_2$, being the same or different, each represent H or an alkyl group, n is an integer of from 1 to 4 and Me is a divalent metallic atom.

7. A silver halide photographic material according to claims 6 characterized in that said divalent metallic atom is selected from Cu, Co, Mn, Sn, Pb, Ni, Zn, Fe, or Mg.

8. A silver halide photographic material according to claim 1, characterized in that said phthalocyanine blue pigment is added to a silver halide light sensitive emulsion layer.

9. A silver halide photographic material according to claim 1, characterized in that said phthalocyanine blue pigment is added in an amount of from 0.001 to 0.5 $g/m^2$.

10. A silver halide photographic material according to claim 1, characterized in that the average diameter to thickness ratio of said tabular silver halide grains is of from 5 to 50.

11. The material of claim 1 wherein said phthalocyanine pigment is within an auxiliary hydrophilic colloid layer.

12. The material of claim 1 wherein said phthalocyanine pigment is within an antihalation layer.

13. The material of claim 1 wherein said phthalocyanine pigment is within a protective layer.

14. The material of claim 1 wherein said phthalocyanine pigment is within a filter layer.

15. A black-and-white silver halide photographic material having at least one silver halide light-sensitive emulsion layer on at least one side of a support, wherein said silver halide emulsion layer comprises tabular silver halide grains having a grain thickness of 0.3 micrometers or less and accounting for at least 50% of the total projected area, characterized in that a water-insoluble phthalocyanine blue pigment having a maximum absorption wavelength of from 640 to 700 nm is present in at least one hydrophilic colloid layer of said photographic material.

* * * * *